US010559411B2

(12) United States Patent
Miyazoe et al.

(10) Patent No.: US 10,559,411 B2
(45) Date of Patent: Feb. 11, 2020

(54) SUPERCONDUCTING MAGNET

(71) Applicant: HITACHI, LTD., Chiyoda-ku, Tokyo (JP)

(72) Inventors: Akihisa Miyazoe, Tokyo (JP); Mitsushi Abe, Tokyo (JP)

(73) Assignee: HITACHI, LTD., Tokyo (JP)

( * ) Notice: Subject to any disclaimer, the term of this patent is extended or adjusted under 35 U.S.C. 154(b) by 568 days.

(21) Appl. No.: 15/317,219

(22) PCT Filed: Jun. 9, 2014

(86) PCT No.: PCT/JP2014/065170
§ 371 (c)(1),
(2) Date: Dec. 8, 2016

(87) PCT Pub. No.: WO2015/189881
PCT Pub. Date: Dec. 17, 2015

(65) Prior Publication Data
US 2017/0117076 A1 Apr. 27, 2017

(51) Int. Cl.
*H01F 6/04* (2006.01)
*H01F 6/06* (2006.01)

(52) U.S. Cl.
CPC ..... *H01F 6/04* (2013.01); *H01F 6/06* (2013.01)

(58) Field of Classification Search
CPC ..... H01F 6/04; H01F 6/06; H01F 6/00
USPC ..... 335/216, 296–300
See application file for complete search history.

(56) References Cited

U.S. PATENT DOCUMENTS 6,081,179 A 6/2000 Kato
2009/0050432 A1* 2/2009 Oh ..... F16D 27/10 192/84.96

(Continued)

FOREIGN PATENT DOCUMENTS

JP 11-186025 A 7/1999
JP 2007-53241 A 3/2007
JP 2012-209381 A 10/2012

*Primary Examiner* — Bernard Rojas
(74) *Attorney, Agent, or Firm* — Miles & Stockbridge, P.C.

(57) ABSTRACT

The objective of the present invention is to provide a conduction-cooling-type super-conducting magnet, wherein a surface pressure is applied between a super-conducting coiled wire portion and a cooling member, the non-uniformity of the surface pressure in the diameter direction of the coiled wire portion has been improved, whereby the uniformity of contact heat resistance has been improved, moreover, warping due to a thermal contraction difference between the cooling member and the coiled wire portion arising at cooling time has been decreased sufficiently, and a surface pressure application mechanism can be installed solely in the low-temperature portion where the super-conducting coiled wire portion is installed. Provided is a conduction-cooling-type super-conducting magnet characterized by: an adequate heat conductor, which is connected to a cooler, in contact with the super-conducting coiled wire portion; the inclusion of an elastic body, which is capable of imparting, in the form of a displacement, an amount of contraction that is sufficiently greater than the amount of contraction of the adequate heat conductor and the wound wire portion at cooling time; and at least one elastic body disposed on each of the inner peripheral side and the outer peripheral side of the coiled wire portion in the same radial direction of the coiled wire portion.

10 Claims, 5 Drawing Sheets

(56) References Cited

U.S. PATENT DOCUMENTS

| | | | | |
|---|---|---|---|---|
| 2012/0135867 | A1* | 5/2012 | Thom | H01P 1/202<br>505/210 |
| 2013/0160975 | A1* | 6/2013 | Stautner | G01R 33/3804<br>165/104.22 |
| 2018/0045796 | A1* | 2/2018 | Schauwecker | G01R 33/34023 |

* cited by examiner

SUPERCONDUCTING MAGNET

TECHNICAL FIELD

The present invention relates to a superconducting magnet.

BACKGROUND ART

There is known, as the background art of the technical field of the present invention, JP-H11-186025-A (Patent Literature 1). Patent Literature 1 discloses as follows: "a superconducting coil has a structure such that a plurality of double-pancake coils is stacked. The double-pancake coils are stacked in a coil axial direction. Cooling plates are disposed between the respective double pancake coils. A plurality of springs is disposed in a circumferential direction so as to apply a pressure to the double-pancake coils in an axial direction." There is also known, as the background art of the technical field of the present invention, JP-2012-209381-A (Patent Literature 2). Patent Literature 2 discloses "a superconducting device including: a superconducting coil; a refrigerator cooling the superconducting coil via a heat transfer path between the refrigerator and the superconducting coil; a vacuum container accommodating therein the superconducting coil and the refrigerator; and a pressure device that detects whether the refrigerator is in a steady operation state or in an abnormal state, and that forms the heat transfer path if detecting that the refrigerator is in the steady operation state and heat-insulates the superconducting coil from the refrigerator if detecting that the refrigerator is in the abnormal state, or a spring that applies a restoring force in a direction of heat-insulating the superconducting coil from the refrigerator when the pressure device malfunctions during power outage."

PRIOR ART LITERATURE

Patent Literature

Patent Literature 1: JP-H11-186025-A
Patent Literature 2: JP-2012-209381-A

SUMMARY OF THE INVENTION

Problem to be Solved by the Invention

However, as disclosed in Patent Literature 1, with the configuration in which a plurality of springs is disposed in the circumferential direction in one location in a radial direction, the pressure applied to a coil winding section of the superconducting coil one-sidedly in the axial direction of the coil winding section is generated from a cooling member to the coil winding section. As a result, contact thermal resistance is made non-uniform in the radial direction.

In this case, if the cooling member is bonded to the coil winding section by a resin or the like, contact thermal resistance can be kept uniform. However, a heat shrinkage difference during cooling causes an excessive strain in the coil winding section, often resulting in the reduction of the superconducting critical current density of the coil winding section.

Furthermore, as disclosed in Patent Literature 2, if one end of the spring is connected to a heat transfer path directly connected to the superconducting coil and the other end of the spring is connected to a member, such as the vacuum container, sufficiently higher in temperature than the superconducting coil, then the thermal effusion to the superconducting coil increases, resulting in the reduction of cooling efficiency for cooling the superconducting coil.

It is an object of the present invention to provide a superconducting magnet capable of improving the uniformity of contact thermal resistance and sufficiently reducing a strain caused by a heat shrinkage difference generated between a cooling member and a superconducting coil winding section during cooling by applying a bearing stress between the coil winding section and the cooling member to mitigate the non-uniformity of the bearing stress in the radial direction of the coil winding section, and capable of installing a bearing stress application mechanism only by a low-temperature section where the superconducting coil winding section is installed.

Means for Solving the Problems

To achieve the object, the present invention adopts a configuration set forth, for example, in claims.

The present application includes a plurality of means for solving the abovementioned problems. By way of example, "a superconducting magnet includes: a thermal conductor connected to a refrigerator; a superconducting coil coming in thermal contact with the thermal conductor; a winding section support for sandwiching a winding section of the superconducting coil between the winding section support and the thermal conductor; an elastic body capable of applying a displacement greater than shrinkages of the thermal conductor and the winding section of the superconducting coil when the thermal conductor and the superconducting coil are cooled from an ambient temperature down to a predetermined temperature; and a fastener joined to the elastic body and fastened to the winding section support," characterized in that "at least one or more elastic bodies are disposed in each of an inner circumferential side and an outer circumferential side of the coil winding section with respect to a same radial direction of the winding section."

Advantage of the Invention

The present invention provides a conducting cooling-type superconducting coil having functions to keep constant a bearing stress applied to the superconducting coil winding section from the cooling member, to prevent the bearing stress from being applied one-sidedly to at least one surface of surfaces of the winding sections, and to make sufficiently small a strain within the coil winding section generated by a heat shrinkage difference between the cooling member and the coil winding section to be able to cool the superconducting coil, and ensuring no change in quantity of thermal flow by having the functions.

MODE FOR CARRYING OUT THE INVENTION

Embodiments will now be described hereinafter with reference to the drawings.

First Embodiment

In the present embodiment, an example of a conducting cooling-type superconducting magnet 100 will be described.

Figure 1:
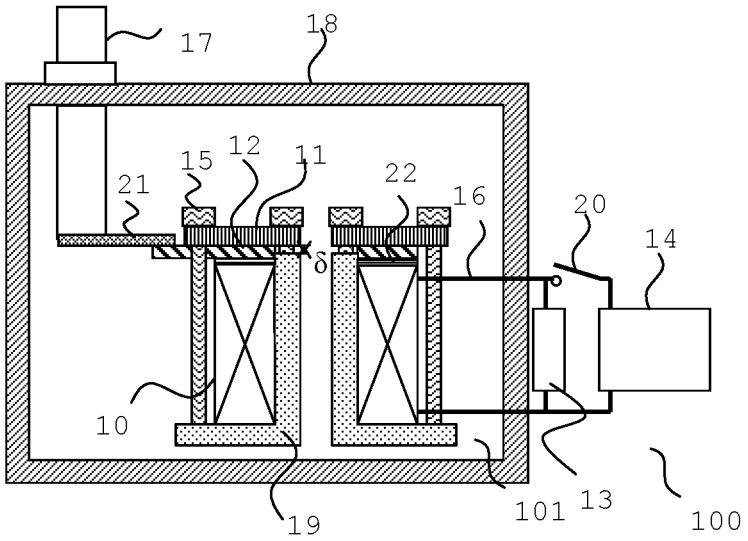
FIG. 1 is a configuration diagram of a conducting cooling-type superconducting magnet device according to a first embodiment of the present invention.

FIG. 1 is a configuration diagram of the conducting cooling-type superconducting magnet 100 according to the present embodiment. Main constituent elements of the superconducting magnet 100 of the present embodiment will be described below.

The superconducting magnet 100 includes, as constituent elements, a vacuum insulated container 18, a superconducting coil 101 and a refrigerator 17 disposed within the vacuum container 18, and a heat transfer member 21 that connects the superconducting coil 101 to the refrigerator 17. Note that the superconducting coil 101 is connected to a power supply 14 via an interconnect line 16. Furthermore, a protection circuit 13, which is configured such that a switch 20 is opened to separate the power supply 14 from the superconducting coil 101 and to consume magnetic energy accumulated in the superconducting coil 101 if the coil temperature increases more than a superconducting critical temperature or the coil current the density exceeds a superconducting critical current density while the current is being carried to the superconducting coil 101, or if emergency demagnetization is necessary in case of the adsorption of a magnetic body or the like, is connected in parallel to the power supply 14.

As the refrigerator 17, a well-known refrigerator such as a Gifford-McMahon (GM) refrigerator, a Gifford-McMahon/Joule-Thomson (GM-JT) refrigerator, a Stirling refrigerator, or a pulse tube refrigerator, for example, can be used. As the heat transfer member 21, a metallic plate such as an aluminum plate or a steel plate or a flexible conductor thereof the thermal conductivity of which is equal to or higher than 100 W/Km at a superconducting coil usage temperature from 4K to 77K, or an electrical insulating plate such as a sapphire plate or a silicon carbide plate, for example, can be used.

As the power supply 14, a DC power supply or an AC power supply, for example, can be used. As the protection circuit 13, a resistor at 0.1Ω to a few Ω and a diode, for example, can be used.

A configuration of the superconducting coil 101 will next be described.

A superconducting coil winding section 10 wound around a spool 19 comes in contact with a thermal conductor 12 via an insulating material 22 with which the superconducting coil winding section 10 contacts on a surface thereof in an axial direction. Therefore, the superconducting magnet 100 according to the present embodiment has a structure such that the superconducting coil winding section 10 is disposed between a bottom portion of the L-shaped spool 19 and the thermal conductor 12 and that the superconducting coil winding section 10 comes in thermal contact with the thermal conductor 12. The thermal conductor 12 is connected to the heat transfer member 21 connected to the refrigerator 17 (serving as a cooling stage of the refrigerator 17).

Note that the axial direction of the superconducting coil winding section 10 means herein a direction of a central axis about which a superconducting wire is wound annularly to form a coil. Furthermore, a plate spring 11 which is an elastic body is installed on a surface of the thermal conductor 12 in order to apply a bearing stress from the thermal conductor 12 to the superconducting coil winding section 10. The plate spring 11 is fastened to the spool 19 by bolts 15 that are fasteners. At least two or more bolts 15 are fastened in a radial direction, and the bolts 15 are fastened at a position inside in the radial direction and a position outside in the radial direction with respect to a position of a central diameter of the superconducting coil 10.

In the present embodiment, a mechanism provided with the bolts 15 and the plate spring 11 is a bearing stress application mechanism, the plate spring 11 is disposed to be deflected between the thermal conductor 12 and head portions of the bolts 15, and tail portions of the bolts 15 are fastened to a bottom of the spool 19. A repulsive force generated by the plate spring 11 acts as a force for pulling up the spool 19 toward the thermal conductor via the bolts 15 and for pressing the superconducting coil winding section 10 of the superconducting coil installed on the spool 19 against the thermal conductor 12.

As shown in FIG. 1, the spool 19 has a cross-sectional shape such that two L-shaped parts are disposed line-symmetrically about the central axis.

The superconducting coil winding section 10 is formed from a superconducting wire such as a niobium-based superconducting wire, a magnesium diboride superconducting wire, a bismuth-based copper oxide superconducting wire or a rare-earth-based superconducting wire, and an insulating material such as a polyimide resin or an epoxy resin. A winding method might be either solenoidal winding or pancake winding. As a material of the spool 19, stainless steel, an aluminum alloy, or fiber reinforced plastic (FRP), for example, is used.

The thermal conductor 12 is preferably a metal or ceramics the thermal conductivity of which is equal to or higher than 100 W/Km at the superconducting coil usage temperature from 4K to 77K. For example, a plate such as an aluminum plate, a copper plate or an aluminum nitride plate, or a flexible conductor made of any of those metals can be used.

As the plate spring 11, a well-known plate spring made of spring steel, for example, can be used.

Figure 2:
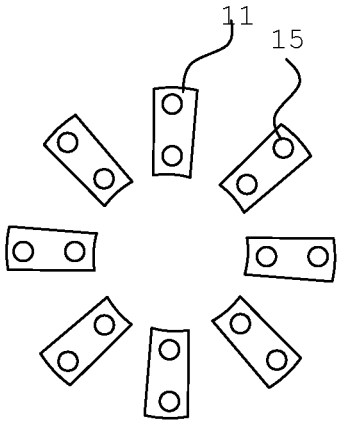
FIG. 2 is a configuration diagram of plate springs according to the first embodiment of the present invention.

FIG. 2 shows an example in which a plurality of plate springs 11 is disposed in a circumferential direction according to the present embodiment. While FIG. 2 shows eight plate spring 11 in the circumferential direction, the number of plate springs 11 may be arbitrarily set in the circumferential direction as long as a predetermined bearing stress can be applied.

It is preferred to set the bearing stress to be equal to or higher than 0.1 MPa and equal to or lower than a few MPa because of the thermal contact conductance between the cooling member 12 and the superconducting coil winding section 10. Note that if the bearing stress equal to or higher than several tens of MPa is applied, a strain generated in the superconducting wire possibly causes the reduction of a critical current of the superconducting wire to be equal to or lower than 90%. For these reasons, the plate spring 11 is adjusted to set the bearing stress between the cooling member 12 and the superconducting coil winding section 10 to be equal to or higher than 0.1 MPa and equal to or lower than 10 MPa.

Next, the shape change of the superconducting coil 101 during cooling will be described.

While taking the following coil by way of example, the shape change will be described.

It is assumed that the superconducting coil winding section 10 having an axial length of 100 mm is formed from a bismuth-based superconducting wire and an insulating material, the thermal conductor 12 is formed from a copper plate having a thickness of 10 mm, the insulating material 22 has a thickness of 1 mm, and the spool 19 is formed from an aluminum alloy.

When the temperature is cooled from an ambient temperature down to 20K, the superconducting coil winding section 10, the thermal conductor 12, and the insulating material 22 shrink and shrinkages thereof can be each calculated by the product between a coefficient of linear expansion and a temperature difference from the ambient temperature to 20K. A total shrinkage of the superconducting coil winding section 10, the thermal conductor 12, and the insulating material 22 is approximately 0.45 mm. On the other hand, a thermal shrinkage of the aluminum alloy spool 19, which can be calculated similarly by the product between a coefficient of linear expansion and the temperature difference from the ambient temperature to 20K, is approximately 0.46 mm. In other words, the heat shrinkage difference of approximately 0.01 mm is generated.

Owing to this, keeping a deflection δ of the plate spring 11 to be equal to more than 1 mm at the ambient temperature makes it possible to keep 99% or more of the bearing stress even during cooling. Furthermore, it is necessary to make the axial length of the spool 19 smaller than the total axial length of the superconducting coil winding section 10, the thermal conductor 12, and the insulating material 22 by δ or more in order to keep the deflection δ at the ambient temperature. To satisfy this deflection δ and the abovementioned bearing stress, a plurality of plate springs 11 may be stacked.

Figure 3:
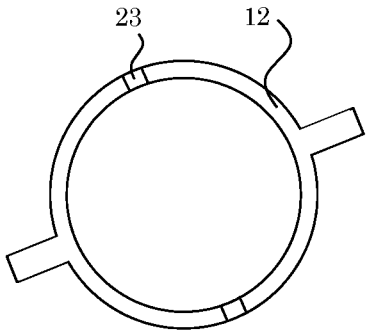
FIG. 3 is a configuration diagram of a thermal conductor according to the first embodiment of the present invention.

FIG. 3 shows a configuration such that two insulating materials 23 are inserted into the thermal conductor 12 in the circumferential direction to cut off an eddy current flow path in the circumferential direction if the thermal conductor 12 is formed from a metal in the present embodiment. A magnetic field is generated when a current is supplied to the superconducting coil 101 after cooling, and an eddy current induced by the generated magnetic field causes a temperature increase. An eddy current density can be reduced by inserting the insulating materials 23. Note that the insulating materials 23 are not always necessary if the thermal conductor 12 is formed from an insulating plate such as a ceramics plate. Moreover, although not shown, if the plate spring 11 can apply the bearing stress to the superconducting coil winding section 10, the thermal conductor 12 may come in contact, at least in part, with a surface of the superconducting coil 10.

As described so far, the superconducting magnet 100 according to the present embodiment includes: the spool 19 having the cross-sectional shape such that the two L-shaped parts are opposite each other across the central axis; the superconducting coil mounted on the spool 19 in such a manner that the superconducting coil is fitted into the spool 19; and the bearing stress application mechanism that includes the bolts 15 and the plate spring 11 and that applies the pressure in the direction of pushing up the spool 19 mounting thereon the superconducting coil winding section 10 toward the thermal conductor 12.

The bearing stress application mechanism works as follows as a mechanism for pushing up the spool 19 mounting thereon the superconducting coil winding section 10 toward the thermal conductor 12 as described above.

First, the elastic body (plate spring 11 in the case of the present embodiment) included in the bearing stress application mechanism is deflected. The elastic body generates the force in the direction of pulling the head portions of the fasteners (bolts 15 in the case of the present embodiment) upward in the vertical direction. The force of the fasteners acts on the spool 19 because the tail portions of the fasteners are fastened to the bottom portion of the spool 19. The superconducting coil winding section 10 is disposed between the bottom portion of the spool 19 and the thermal conductor 12. The force acting on the spool 19, therefore, becomes the force for pressing the superconducting coil winding section 10 against the thermal conductor 12, so that the bearing stress is applied and kept applied between the superconducting coil winding section 10 and the thermal conductor 12.

It is more preferable that the deflection that is to be given to the elastic body be set equal to or larger than 100 times as large as the difference between the heat-shrinkage of the spool 19 when the superconducting coil is cooled from the ambient temperature down to an ultra-low temperature and the heat-shrinkage of the thermal conductor 12 and the superconducting coil winding section 10 under the same condition. By so setting, even if the heat-shrinkage of the superconducting coil winding section 10 and the thermal conductor 12 does not match the heat-shrinkage of the spool 19, it is possible to keep constant the bearing stress between the superconducting coil winding section 10 and the thermal conductor 12, realize a stable cooling function, and eventually provide the superconducting magnet 100 capable of stably operating compared with conventional superconducting magnets.

Second Embodiment

In the present embodiment, an example of a superconducting coil 200 capable of improving not only the uniformity of the bearing stress in the radial direction but also the uniformity thereof in the circumferential direction will be described.

Figure 4:
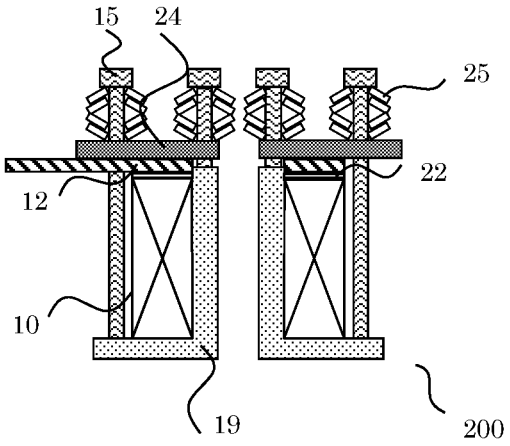
FIG. 4 is a configuration diagram of a conducting cooling-type superconducting magnet device according to a second embodiment of the present invention.

FIG. 4 is an example of a configuration diagram showing the superconducting coil 200 according to the second embodiment.

Of the superconducting coil 200 shown in FIG. 4, parts having the same functions as those of the constituent elements denoted by the same reference symbols and shown in FIG. 1 as already described above will not be repeatedly described herein.

The superconducting coil 200 is configured such that a spring 25 and a push plate 24 are provided in each bolt 15 as a mechanism for applying the bearing stress to the superconducting coil winding section 10 from the thermal conductor 12. Therefore, the bearing stress application mechanism according to the present embodiment includes the bolts 15, the springs 25, and the push plate 24.

Figure 5:
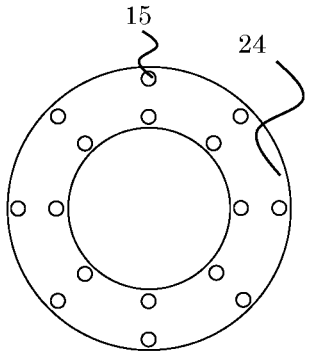
FIG. 5 is a configuration diagram showing the disposition of a push plate and bolts according to the second embodiment of the present invention.

FIG. 5 is an example of a configuration diagram showing the continuous push plate 24 in the circumferential direction according to the present embodiment.

Making the push plate 24 exhibit rigidity substantially equal to or higher than that of the thermal conductor 12 enables the improvement in the uniformity of the bearing stress in the circumferential direction. As the push plate 24, a metallic plate such as an aluminum alloy plate or a stainless steel plate, or an insulating material such as a ceramics plate or an FRP plate, for example, can be used. However, it is preferred that the push plate 24 is formed from the insulating material with a view to reducing eddy current heat generation while a current is being carried to the superconducting coil 200.

As the bolts 15, a combination of a hexagon head bolt, a stud bolt, and a nut can be used. As each spring 25, a coned disc spring or a coiled spring that can satisfy the deflection δ and the bearing stress as described in the first embodiment can be used.

An example of using the coned disc springs as the elastic bodies provided in the bearing stress application mechanism will be shown below.

On a winding upper surface having an area of 0.1 $m^2$, 12 stainless steel heavy load coned disc springs (nominal 20) are installed concentrically in each of two locations in the same radial direction, that is, 24 coned disc springs are installed in all. If the coned disc springs are disposed two in parallel by nine in series, it is possible to apply the bearing stress equal to or higher than 0.2 MPa with $\delta>1$ mm.

The superconducting magnet 100 according to the present embodiment includes the bearing stress application mechanism including, as the constituent element, the push plate 24 continuous in the circumferential direction. It is thereby possible to make constant the bearing stress not only in the radial direction but also in the circumferential direction compared with the first embodiment; it is, therefore, possible to further improve the stability of the cooling function.

Third Embodiment

In the present embodiment, an example of a superconducting coil 300 configured such that a coil position is supported without using the spool will be described.

Figure 6:
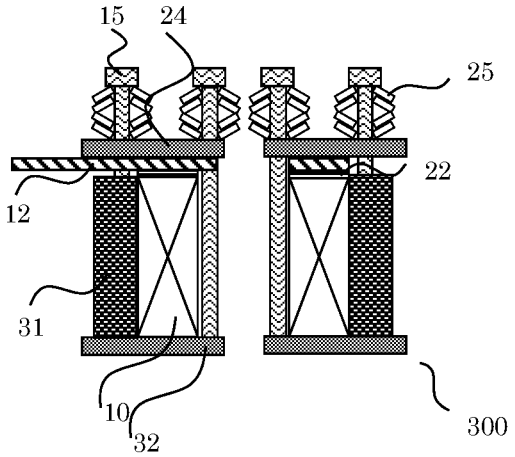
FIG. 6 is a configuration diagram of a conducting cooling-type superconducting magnet device according to a third embodiment of the present invention.

FIG. 6 is an example of a configuration diagram showing the superconducting coil 300 according to the third embodiment.

Of the superconducting coil 300 shown in FIG. 6, parts having the same functions as those of the constituent elements denoted by the same reference symbols and shown in FIG. 1 or FIG. 4 as already described above will not be repeatedly described herein.

In the present embodiment, the position of the superconducting coil winding section 10 is supported by a winding section support member 31 in the radial direction. Furthermore, the superconducting coil winding section 10 is sandwiched between push plates 24 and 32 on upper and lower surfaces of the superconducting coil winding section 10 in the axial direction, respectively, and the bearing stress is applied to the superconducting coil winding section 10 by a restoring force of the springs 25.

If a current is carried to the superconducting coil winding section 10, a force is applied to outside, in the radial direction, of the superconducting coil winding section 10 by a hoop tension. Therefore, in order to support the coil position by the spool which is inside, in the radial direction, of the superconducting coil winding section 10 while a current is being carried to the superconducting coil winding section 10, it is necessary to wind the coil at a tension equal to or higher than the hoop tension or to use a spool smaller than the superconducting coil winding section 10 in the heat-shrinkage during cooling. On the other hand, a permissible strain of the bismuth-based superconducting wire, the magnesium diboride wire, a triniobium-tin superconducting wire or the like is as small as approximately 0.2% to 0.3%. In the present embodiment, the position of the superconducting coil winding section 10 in the radial direction is restricted by the winding section support member 31, so that it is possible to suppress the deformation of the superconducting coil winding section 10 and relax the strain thereof while a current is being carried to the superconducting coil winding section 10. It is, therefore, possible to facilitate manufacturing a coil using a wire having a small permissible strain. Furthermore, the bolts 15 can assume two roles, that is, the role of determining the position of the winding section support member 31 and the role of applying the bearing stress to the superconducting coil winding section 10 in such a manner that the force generated by the springs 25 is used to press the superconducting coil winding section 10 against the thermal conductor 12.

Note that the superconducting coil winding section 10 is disposed on the winding section support member 31 in the present embodiment, while the bottom portion of the L-shaped cross-section of the spool 19 functions as a winding section support for the superconducting coil winding section 10 in the first and second embodiment.

Fourth Embodiment

In the present embodiment, an example of a superconducting magnet 400 for cooling the superconducting coil using not only the refrigerator but also refrigerant accommodated in the vacuum insulated container will be described.

Figure 7:
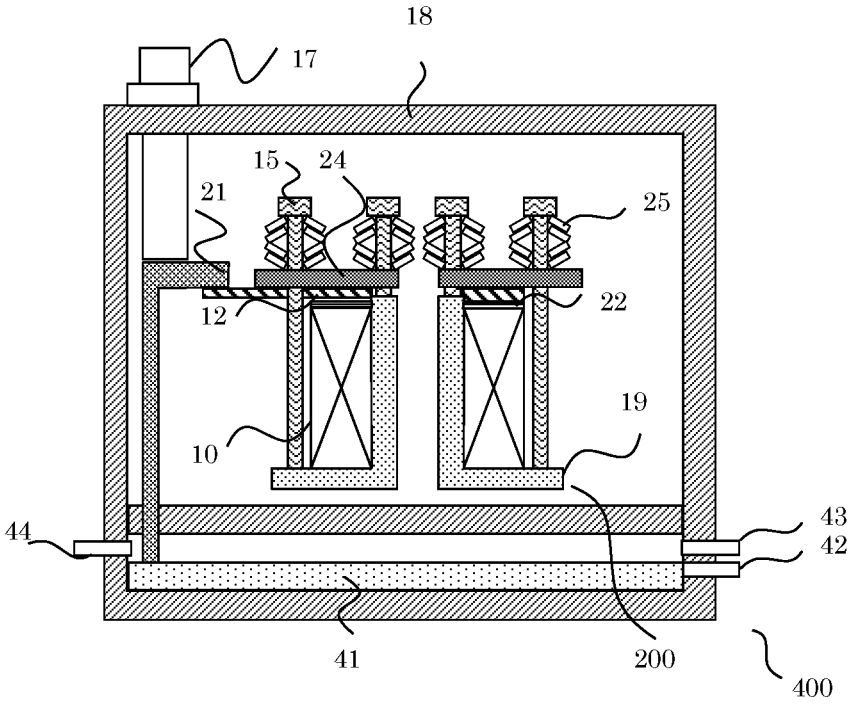
FIG. 7 is a configuration diagram of a conducting cooling-type superconducting magnet device according to a fourth embodiment of the present invention.

FIG. 7 is an example of a configuration diagram showing a superconducting magnet 400 according to the fourth embodiment.

Of the superconducting magnet 400 shown in FIG. 7, parts having the same functions as those of the constituent elements denoted by the same reference symbols and shown in FIG. 1 or FIG. 4 as already described above will not be repeatedly described herein.

In the present embodiment, refrigerant 41 is accommodated in a space different from a space where the superconducting coil 200 is disposed within the vacuum insulated container. As the volume of the superconducting coil 200 increases, cooling time increases; however, the cooling time can be shortened by using the refrigerant 41.

As the refrigerant 41, liquid nitrogen, liquid helium, liquid hydrogen, or liquid neon, for example, can be used. A method of cooling the superconducting magnet 400 will next be described.

When the temperature is cooled down from the ambient temperature, the refrigerant is filled from a refrigerant inlet pipe 42 attached to the vacuum insulated container 18. During filling, a refrigerant outlet pipe 43 is always kept opened. After the refrigerant 41 has been filled, the refrigerant inlet pipe 42 is closed, a safety valve is attached to the refrigerant outlet pipe 43, and a pressure pipe 44 transfers heat to the refrigerant 41 via the heat transfer member 21 which is partially a pipe. At the same time, the refrigerator 17 cools the superconducting coil winding section 10 via the heat transfer member 21 and the thermal conductor 12.

Fifth Embodiment

In the present embodiment, an example of a superconducting magnet 500 when a plurality of superconducting coils is disposed within the vacuum insulated container will be described.

Figure 8:
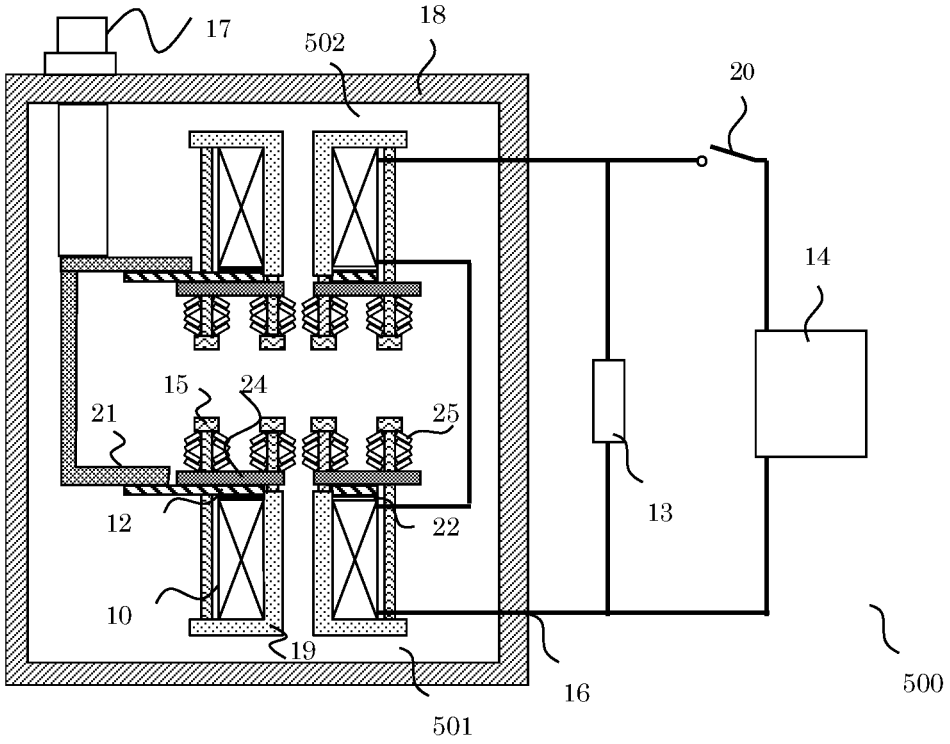
FIG. 8 is a configuration diagram of a conducting cooling-type superconducting magnet device according to a fifth embodiment of the present invention.

FIG. 8 is an example of a configuration diagram showing the superconducting magnet 500 according to the fifth embodiment.

Of the superconducting magnet 500 shown in FIG. 8, parts having the same functions as those of the constituent elements denoted by the same reference symbols and shown in FIG. 1 or FIG. 4 as already described above will not be repeatedly described herein.

In the present embodiment, two superconducting coils 501 and 502 are connected in series through an interconnect line 16 and disposed to face each other. Furthermore, the springs 25 are placed near the counterpart coils.

When a current is carried to the superconducting coil 500 and the superconducting coils 501 and 502 operate as Helmholtz coils, the two coils attract each other. An attraction force F is specified by a current value and a distance between the coils. If it is assumed that a contact area between the thermal conductor 12 and the insulating material 22 is S, a bearing stress F/S applied to the superconducting coil 10 from the thermal conductor 12 is added to the bearing stress which has been applied by the springs 25 at the ambient temperature. As a result, the contact bearing stress increases and the contact thermal resistance decreases.

Moreover, although not shown, if the superconducting coils 501 and 502 operate as cusp coils, a repulsive force is generated in both of the coils. It is, therefore, preferred to install the springs 25 on the side on which the repulsive force acts.

Likewise, if the magnetic body is disposed near the superconducting coil, it is preferred to dispose the springs 25 in the direction of the force acting on each coil in the axial direction.

DESCRIPTION OF REFERENCE CHARACTERS

100, 400, 500: Conducting cooling-type superconducting magnet
101, 200, 300, 501, 502: Superconducting coil
10: Superconducting coil winding section
11: Plate spring (elastic body)
12: Thermal conductor
13: Protection circuit
14: Power supply
15: Bolt
16: Interconnect line
17: Refrigerator
18: Vacuum insulated container
19: Spool
20: Switch
21: Heat transfer member
22, 23: Insulating material
24, 32: Push plate
25: Spring
31: Winding section support member
41: Refrigerant
42: Refrigerant inlet pipe
43: Refrigerant outlet pipe
44: Pressure pipe

The invention claimed is:

1. A superconducting magnet comprising:
a thermal conductor connected to a refrigerator;
a superconducting coil coming in thermal contact with the thermal conductor;
a winding section support for sandwiching a winding section of the superconducting coil between the winding section support and the thermal conductor;
an elastic body capable of applying a displacement greater than shrinkages of the thermal conductor and the winding section of the superconducting coil when the thermal conductor and the superconducting coil are cooled from an ambient temperature down to a predetermined temperature; and
a fastener joined to the elastic body and fastened to the winding section support, wherein
at least one or more said elastic bodies are disposed in each of an inner circumferential side and an outer circumferential side of the coil winding section with respect to a same radial direction of the winding section.

2. The superconducting magnet according to claim 1, wherein
two or more of said elastic bodies are disposed at least in each of two or more locations in a circumferential direction of the superconducting coil.

3. The superconducting magnet according to claim 1, wherein
the thermal conductor is divided at least in the circumferential direction.

4. The superconducting magnet according to claim 1, comprising
a push plate that is a continuous body in the circumferential direction of the superconducting coil, between the at least two or more said elastic bodies and the coil winding section.

5. The superconducting magnet according to claim 1, comprising
a spool provided on the inner circumferential side of the winding section of the superconducting coil.

6. The superconducting magnet according to claim 1, comprising
a winding section support member provided on the outer circumferential side of the winding section of the superconducting coil.

7. The superconducting magnet according to claim 1, comprising a pipe to which refrigerant and the thermal conductor are connected.

8. A superconducting magnet including a plurality of the superconducting coil winding sections according to claim 1 to be disposed therein, each comprising
one said elastic body provided in a direction where an electromagnetic force of each of the superconducting coil winding sections acts.

9. The superconducting magnet according to claim 1, comprising:
a magnetic body provided in an axial direction of the superconducting coil winding section; and
one said elastic body provided in a direction where an electromagnetic force of the superconducting coil acts.

10. A conducting cooling-type superconducting magnet in which a thermal conductor connected to a refrigerator comes in contact with a superconducting coil winding section, comprising:
an elastic body capable of applying, as a displacement, a shrinkage sufficiently larger than shrinkages of the thermal conductor and the winding section when the thermal conductor and the winding section are cooled to the thermal conductor and the winding section, wherein
at least one or more said elastic bodies are disposed in each of an inner circumferential side and an outer circumferential side of the coil winding section with respect to a same radial direction of the coil winding section.

* * * * *